US010228189B1

(12) United States Patent
Buck et al.

(10) Patent No.: US 10,228,189 B1
(45) Date of Patent: Mar. 12, 2019

(54) HEATING SYSTEM FOR COMPOSITE MATERIALS

(71) Applicant: Rapid TPC, LLC, Pittsburgh, PA (US)

(72) Inventors: Kevin Jason Buck, Doylestown, PA (US); Miguel Angel Rodriguez, Homestead, PA (US); Mark Jreissaty, Pittsburgh, PA (US); Benjamin Louis Charley, Pittsburgh, PA (US)

(73) Assignee: Rapid TPC, LLC, Pittsburgh, PA (US)

( * ) Notice: Subject to any disclaimer, the term of this patent is extended or adjusted under 35 U.S.C. 154(b) by 87 days.

(21) Appl. No.: 14/713,510

(22) Filed: May 15, 2015

Related U.S. Application Data

(60) Provisional application No. 61/994,102, filed on May 15, 2014, provisional application No. 61/994,428, filed on May 16, 2014.

(51) Int. Cl.
*F27B 1/00* (2006.01)
*F27B 1/21* (2006.01)
*F27B 1/12* (2006.01)

(52) U.S. Cl.
CPC ..... *F27B 1/005* (2013.01); *F27B 1/12* (2013.01); *F27B 1/21* (2013.01)

(58) Field of Classification Search
CPC .... F27B 9/142; F27B 9/22; F27B 9/24; A21B 1/44; A21B 1/46; F27D 2003/128; F27M 2002/10; H01L 21/67757
USPC ..... 432/122, 143, 144, 131
See application file for complete search history.

(56) References Cited

U.S. PATENT DOCUMENTS 2,539,423 A * 1/1951 Howard ..... A21B 1/46 126/273 R
2,926,897 A * 3/1960 Barnett ..... B22C 9/12 34/208
3,091,833 A * 6/1963 Kovach ..... F26B 15/24 432/124
3,790,336 A * 2/1974 Brede, III ..... B22F 3/003 432/125
4,118,181 A * 10/1978 Onodera ..... A21B 1/48 432/121
4,581,063 A * 4/1986 Oyabu ..... F27B 3/045 266/200
4,717,339 A * 1/1988 Kersting ..... F27B 9/10 34/194

(Continued)

FOREIGN PATENT DOCUMENTS

GB 2021743 A * 12/1979 ..... F27B 9/147
JP 01203886 A * 8/1989

(Continued)

*Primary Examiner* — Gregory A Wilson
(74) *Attorney, Agent, or Firm* — The Webb Law Firm

(57) ABSTRACT

A heating system for heating composite materials includes a housing defining a cavity therein, a vertical conveyor system provided in the cavity of the housing for moving objects through the housing, and a heating arrangement provided in the housing for heating the objects that are moved through the housing. The heating arrangement may include at least one heating element provided in at least one of an upper portion of the housing and a lower portion of the housing. The heating arrangement may include at least one fan to circulate heated air generated by the heating arrangement throughout the cavity of the housing.

16 Claims, 12 Drawing Sheets

(56) References Cited

U.S. PATENT DOCUMENTS

| | | | | | |
|---|---|---|---|---|---|
| 6,164,961 | A * | 12/2000 | Luscher | A21B 1/42 | 198/465.1 |
| 6,210,156 | B1 * | 4/2001 | Horvath, Jr. | F27B 9/147 | 414/152 |
| 6,227,848 | B1 * | 5/2001 | Imai | F27B 9/142 | 198/775 |
| 6,267,587 | B1 * | 7/2001 | Bishop | F26B 11/18 | 414/147 |
| 6,305,930 | B1 * | 10/2001 | Fedak | F27B 9/00 | 34/209 |
| 6,499,994 | B1 * | 12/2002 | Murakami | F27B 9/023 | 219/85.17 |
| 6,997,705 | B2 * | 2/2006 | Tang | B23K 1/008 | 126/21 A |
| 7,897,101 | B2 * | 3/2011 | Vincoli | C21D 1/00 | 148/559 |
| 8,646,383 | B1 * | 2/2014 | Howard | A23L 5/15 | 126/19 R |
| 9,222,729 | B2 * | 12/2015 | Bors | F27B 9/36 | |
| 9,538,766 | B2 * | 1/2017 | Weiss | A21B 1/46 | |
| 2003/0190574 | A1 * | 10/2003 | Schmid | H01L 21/67706 | 432/121 |
| 2010/0209864 | A1 * | 8/2010 | Pichl | G01R 31/2867 | 432/249 |

FOREIGN PATENT DOCUMENTS

| | | | |
|---|---|---|---|
| JP | 2010121856 | A * | 6/2010 |
| JP | 5376631 | B2 * | 12/2013 |

* cited by examiner

HEATING SYSTEM FOR COMPOSITE MATERIALS

CROSS-REFERENCE TO RELATED APPLICATIONS

This application claims the benefit of U.S. Provisional Patent Application No. 61/994,102, filed May 15, 2014, and U.S. Provisional Patent Application No. 61/994,428, filed May 16, 2014, the disclosures of which are incorporated herein in their entireties.

BACKGROUND OF THE INVENTION

Field of the Invention

This disclosure relates generally to parts manufacturing, in particular composite parts manufacturing. More particularly, the disclosure relates to a heating system for composite parts manufacturing.

Description of Related Art

Over the past several decades, military and commercial aircraft manufacturers have increased the use of composite materials in large aircraft. Among other properties, composite materials tend to be lighter than conventional materials (e.g., riveted aluminum and honeycomb structures). Composite material parts are typically made from multiple layers of "prepreg" (e.g., carbon or fiber-glass fabric pre-impregnated with resin), which are draped in multiple directions over a steel or aluminum mold to be formed into a specific part. The structure or composite material is then cured, which serves to heat the composite material part (and resin) to a sufficient temperature to melt the resin and cross-link the resin molecules to achieve a cured part. Typically, the final cure temperature is in the range of 250 degrees Fahrenheit to 350 degrees Fahrenheit. Temperature uniformity of the composite material structure during the curing process is critical because non-uniformity of temperature in a cured part can result in permanent warping of the structure, thereby changing the structural integrity and stability of the part.

Aerospace autoclaves have been used to cure large composite material structures for aircraft and aerospace parts. An autoclave is a large pressure vessel that incorporates high pressure, high temperature, and vacuum to consolidate, bond, and cure composite material structures. However, such autoclaves are expensive to install and operate, and require a large amount of space to house within a warehouse or manufacturing plant, which makes the use of autoclaves not very cost-effective for use in the manufacturing of smaller composite parts.

Industrial ovens have also been used to cure composite material parts for aircraft and aerospace vehicles. Such an oven is a large box-shaped unit that has typically been used to cure smaller non-structural composite material parts and operates by directing heated airflow over a composite material part in a side-to-side, side-to-top, bottom-to-top, or top-to-side manner across the width of the oven. Such ovens, unlike autoclaves, operate at atmospheric pressure and so do not apply additional pressure to the composite material parts. The industrial ovens, however, are still typically large in size, often being the size of a greater part of a room. These industrial ovens also require a large amount of space to cure smaller composite material parts.

More recently in composite parts manufacturing, thermoplastic matrix material has been gaining momentum. The basic process for manufacturing these parts from this relatively new material is to provide fiber thermoplastic composite pre-impregnated rolls of tape and stack multiple layers of the tape to create a laminate. The laminate may then be heated to a predefined forming temperature and moved into a forming device. The formed laminate is then cooled between a matched die mold to form a three-dimensional part. Traditionally, this has been done one laminate at a time using direct infrared heating elements. This method requires large amounts of energy and does not necessarily provide uniform heating, which causes warping in the final part, variable part thicknesses, and oxidation of the thermoplastic.

Accordingly, there is a current need for a smaller heating system for heating composite materials to make smaller composite material parts. In the current composite materials industry, a majority of parts constructed from composite materials are large in dimension and require a large oven or heating source to cure the entire composite material part. There is a current need for a smaller heating system that can be used to heat small size composite parts for industries other than the aircraft industry. There is a current need for a heating system that can heat composite material used to create smaller composite material parts that are considerably smaller in size than aircraft wings or fuselages. There is a current need for a heating system that can provide smaller composite material parts at less cost using less energy and space than industrial ovens or autoclaves. There is also a current need for a heating system capable of uniformly heating composite laminates and reducing the need for physical labor.

SUMMARY OF THE INVENTION

Accordingly, and generally, a heating system for heating composite materials and a method of heating composite materials are provided to address and/or overcome some or all of the deficiencies and drawbacks associated with existing composite material heating systems.

In accordance with one aspect of the disclosure, a heating system for heating composite materials may include a housing defining a cavity therein, a vertical conveyor system provided in the cavity of the housing for moving objects through the housing, and a heating arrangement provided in the housing for heating the objects that are moved through the housing.

The heating arrangement may include at least one heating element provided in at least one of an upper portion of the housing and a lower portion of the housing. The heating arrangement may include at least one fan to circulate heated air generated by the heating arrangement throughout the cavity of the housing. The heating arrangement may include at least one down-draft fan configured to move the heated air into the cavity of the housing and an up-draft fan configured to push the heated air out of the cavity of the housing. At least one pusher mechanism may be provided in a lower portion of the cavity of the housing. The at least one pusher mechanism may be configured to push the objects out of the housing. The at least one pusher mechanism may include a rotatable chain member, and a pusher housing provided on the chain member. As the chain member is rotated, the pusher housing may contact the objects and pushes the objects out of the cavity of the housing. The vertical conveyor system may include at least two vertical chain member arrangements, and at least one platform attached to each vertical chain member arrangement. When the objects may be seated on the platforms and the vertical chain member arrangements rotate within the housing, the object and platforms may be lowered from an upper portion of the cavity of the housing to a lower portion of the cavity of the housing. The housing may include an outer housing and an inner housing provided within the outer housing. The vertical conveyor system and the heating arrangement may be provided in the inner housing. The housing may include an insulation layer provided between the outer housing and the inner housing. An exhaust port may be defined in a top surface of the housing. A front opening may be defined in a front surface of the housing and a front door may be provided over the front opening. A rear opening may be defined in a rear surface of the housing and a rear door may be provided over the rear opening. The front opening may receive the objects to be heated in the heating system and the rear opening may discharge the objects once the objects have been heated. The front opening may be defined in a higher portion of the housing than the rear opening. The front door and the rear door may be biased towards a closed position via an actuating member.

In another aspect of the present disclosure, a heating system for heating composite materials may include a housing defining a cavity therein, an object transportation system provided in the cavity of the housing for moving objects through the housing, a heating arrangement provided in the housing for heating the objects that are moved through the housing, and at least one object holding arrangement configured to hold the object as the object is moved through the heating system.

The at least one object holding arrangement may include a frame member and at least one clamping member biased against a top surface of the frame member. The frame member and the at least one clamping member may be arranged so as to hold the object therebetween. At least one compression spring may be provided on the at least one clamping member to bias the at least one clamping member against the frame member. The frame member may define a cavity therein. The at least one object holding arrangement may be removably positioned on the conveyor system to move the object holding arrangement within the heating system.

In accordance with a further aspect of the present disclosure, a method of heating a composite material in a heating system may include: a) inserting a composite material into a heating system; b) generating heated air within the heating system; c) moving the composite material in a vertical direction through an interior cavity of the heating system, thereby heating the composite material with the heated air; and d) discharging the composite material from the heating system. The method may further include pushing the composite material out of the heating system using a pusher mechanism provided in the heating system. The method may further include clamping the composite material in an object holding arrangement before inserting the composite material into the heating system.

Further details and advantages will be understood from the following detailed description read in conjunction with the accompanying drawings.

DESCRIPTION OF THE DISCLOSURE

Figure 1:
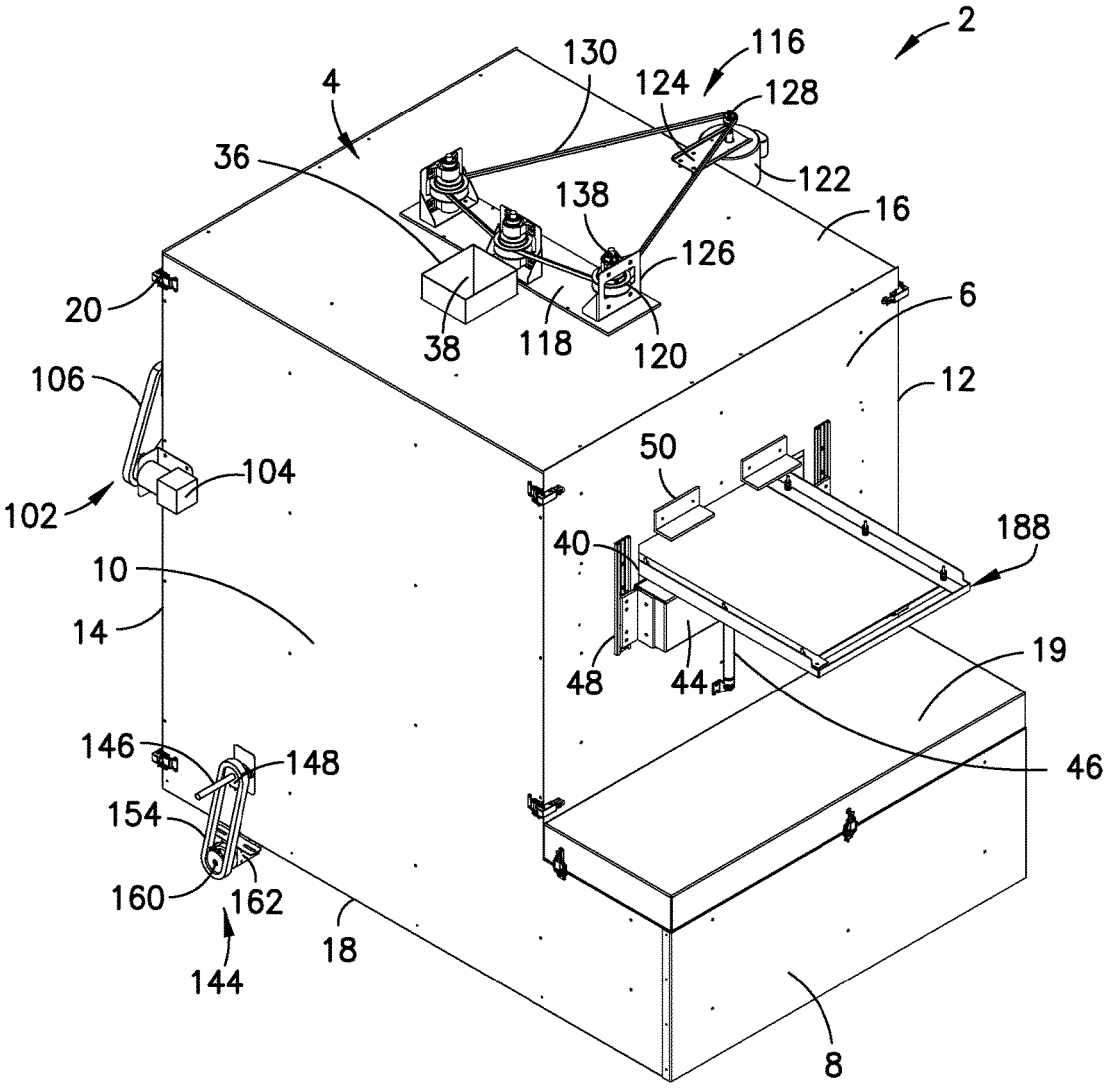
FIG. 1 is a front perspective view of a heating system according to the present disclosure.

For purposes of the description hereinafter, spatial orientation terms, as used, shall relate to the referenced aspect as it is oriented in the accompanying drawings, figures, or otherwise described in the following detailed description. However, it is to be understood that the aspects described hereinafter may assume many alternative variations and configurations. It is also to be understood that the specific components, devices, features, and operational sequences illustrated in the accompanying drawings, figures, or otherwise described herein are simply exemplary and should not be considered as limiting.

The present disclosure is directed to, in general, composite parts manufacturing and, in particular, to a heating system for composite parts manufacturing. Certain preferred and non-limiting aspects of the components of the heating system are illustrated in FIGS. 1-13. A description of the heating system is provided below, followed by a description of a method of using the heating system.

With reference to FIGS. 1-6, a heating system 2 used for a composite parts manufacturing process is shown. The heating system 2 is desirably adapted for composite parts manufacturing. In one non-limiting aspect, a composite part may be defined as a material made from two or more constituent materials with different physical and/or chemical characteristics that, when combined, produce a material with characteristics different from the individual components. For example, the present invention is particularly suited for heat treatment of fiber thermoplastic composite material. However, the heating system 2 may be applied to alternative processes that require a concentrated heat source to increase the temperature of a particular item. In one aspect, the heating system 2 may include an outer housing 4 that is provided to hold the components of the heating system 2. The outer housing 4 may include an upper front panel 6, a lower front panel 8, two sides panels 10, 12, a rear panel 14, a top panel 16, and a bottom panel 18. The lower front panel 8 may be provided outwardly from the upper front panel 6 to house certain components of the heating system 2, as will be described below. A maintenance panel 19 may be provided between the upper front panel 6 and the lower front panel 8 to allow access to the inner components of the heating system 2. The maintenance panel 19 may extend from the upper front panel 6 outwardly to the lower front panel 8. In one non-limiting aspect, the heating system 2 may be provided as a table-top unit. It is to be understood, however, that the heating system 2 may be scaled to a desired size, such as table- or desk-top to an industrial size heating system.

The outer housing 4 may be formed as a single, monolithic structure or, alternatively, may be constructed from separate panel sections. In one non-limiting aspect, the panels of the outer housing 4 may be connected to one another via hinge members 20. The hinge members 20 may be permanently attached to the panels 6-18 or, alternatively, removably attached to the panels 6-18 to allow the removal of a panel from the outer housing 4 for replacement or repair. In another aspect, the panels 6-18 of the outer housing 4 may also be fastened to one another using fastening members or welded together. In one aspect, the panels 6-18 may be made of metal, such as stainless steel. In another aspect, the panels 6-18 may be made of sheet steel layered with rockwool and/or alumina silica in two or more layers. However, it is contemplated that alternative materials may be used to construct the outer housing 4, such as aluminum and other heat resistant metals. In one aspect, the outer housing 4 may be substantially cuboid-shaped. In another aspect, the outer housing 4 may have a rectangular footprint or other shapes and configurations. The maintenance panel 19 may be removably attached to the outer housing 4 to allow an operator to access the inner components of the heating system 2. The maintenance panel 19 may be hingedly connected to the outer housing 4 or removably fastened to the outer housing 4 to permit the operator to open and close the maintenance panel 19 as desired.

Figure 4:
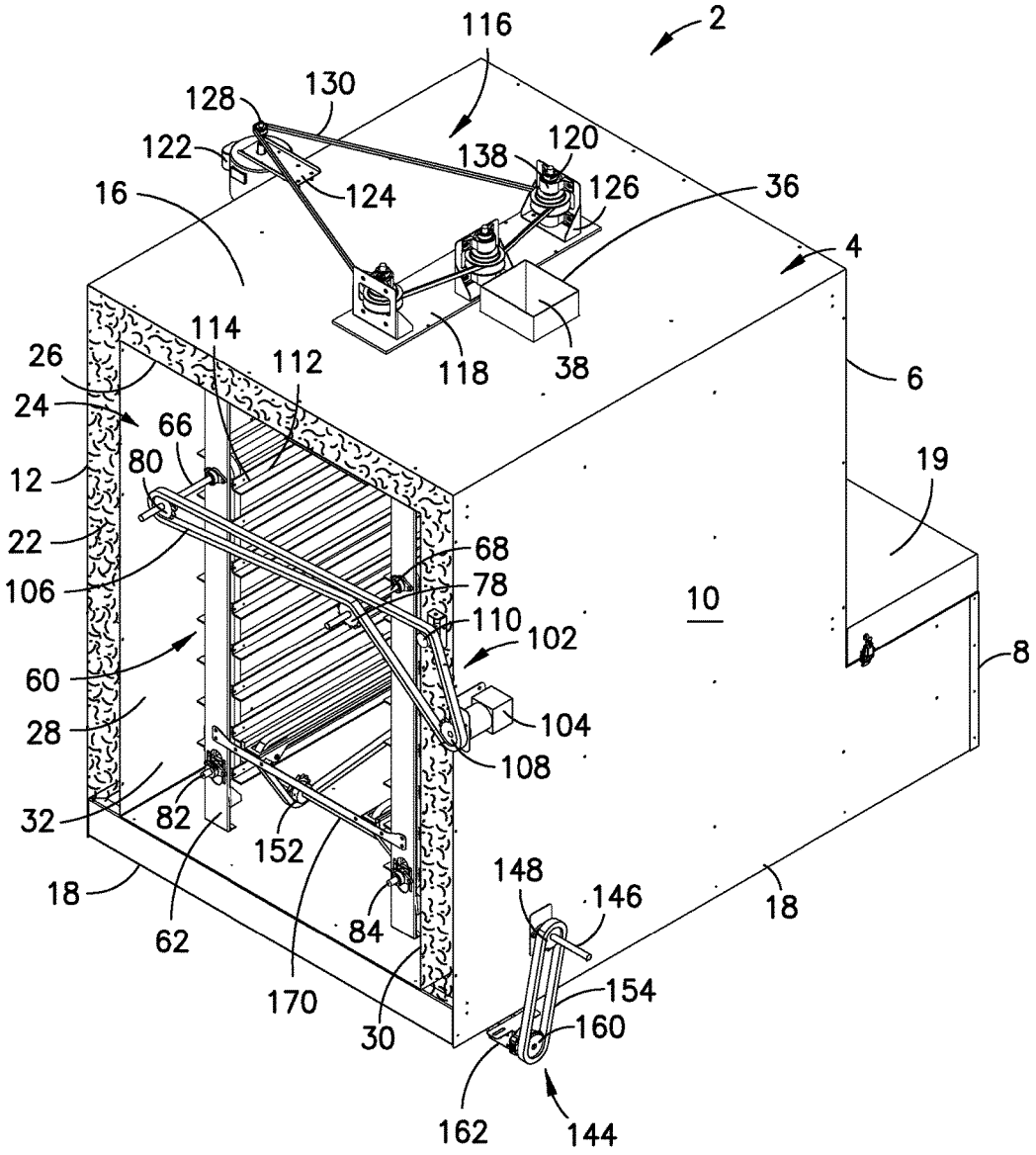
FIG. 4 is a rear perspective view of the heating system of FIG. 1 with a rear panel removed.
Figure 5:
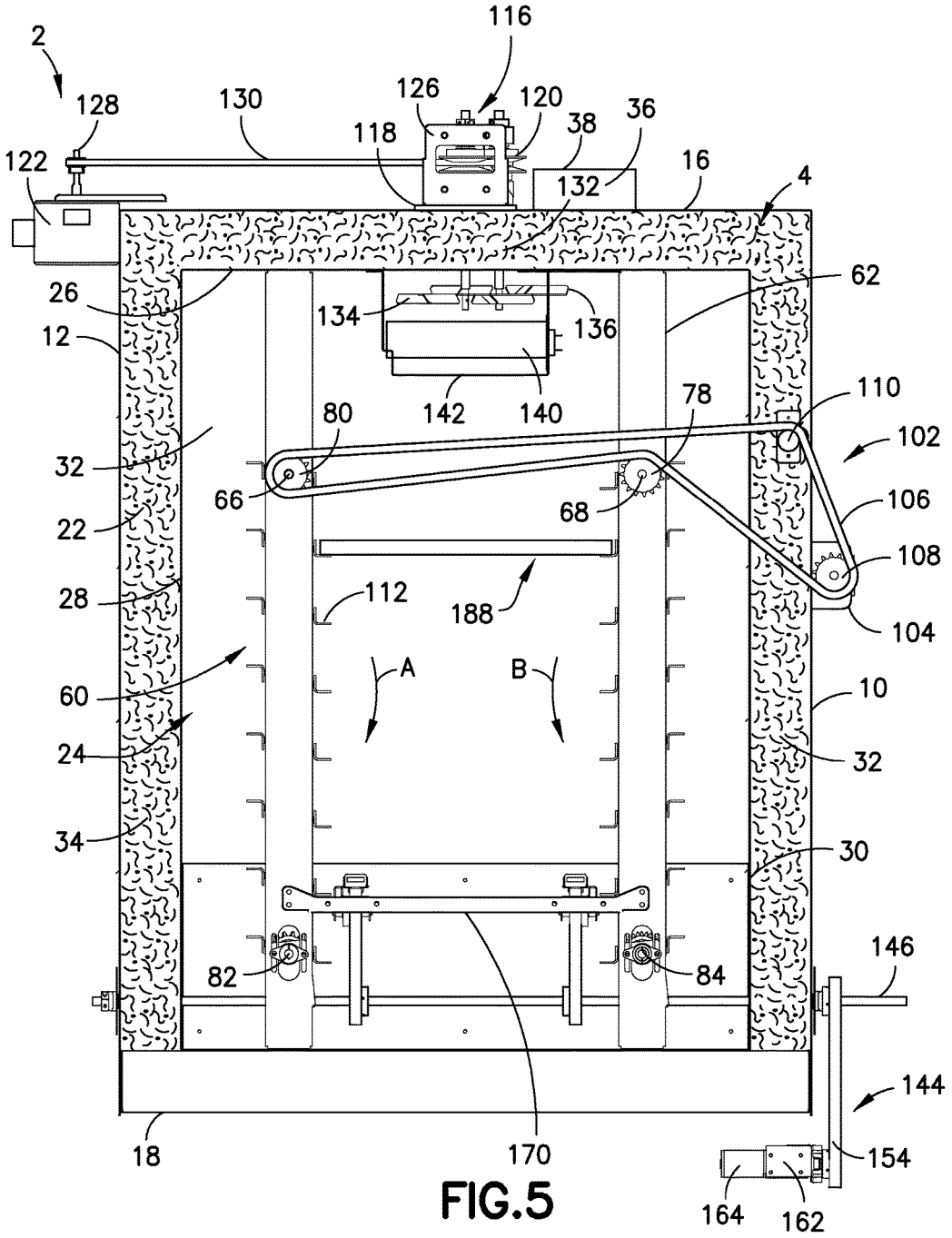
FIG. 5 is a rear view of the heating system of FIG. 1 with the rear panel removed.

As shown in FIGS. 4 and 5, the outer housing 4 may define an outer cavity 22. The outer cavity 22 may be configured to house an inner housing 24. The inner housing 24 may be configured to hold the main components of the heating system 2. The inner housing 24 may include a top panel 26 and two side panels 28, 30. Similar to the outer housing 4, the panels 26-30 of the inner housing 24 may be formed as a single, monolithic structure, welded together, fastened together, or hingedly connected to one another. The panels 26-30 may be made of metal, such as stainless steel, sheet steel layered with alumina silica, aluminum, or another heat resistant material. The bottom panel 18 of the outer housing 4 may also serve as a bottom panel for the inner housing 24. It is also contemplated that a separate bottom panel may be provided with the inner housing 24. The side panels 28, 30 may be fastened to the bottom panel 18 of the outer housing 4. Further, the front panels 6, 8 and the maintenance panel 19 may also serve as a front panel of the inner housing 24. It is also contemplated that a separate front panel may be provided with the inner housing 24. The rear panel 14 of the outer housing 4 may also serve as a rear panel of the inner housing 24. It is also contemplated that a separate rear panel may be provided with the inner housing 24.

The inner housing 24 may define an inner cavity 32 that houses the main components of the heating system 2. The front panels 6, 8, the maintenance panel 19, and the rear panel 14 may be fitted tightly against the inner housing 24 to create a sealed inner cavity 32 that is configured to retain any heat that is generated in the inner cavity 32. As shown in FIGS. 4 and 5, insulating material 34 may be provided between the outer housing 4 and the inner housing 24. The insulating material 34 may be fiberglass or rock wool. However, alternative types of insulating material may be used to keep any heat generated in the inner housing 24 from escaping from the heating system 2. The insulating material 34 may be provided in the inner cavity 32. In one aspect, the insulating material 34 may be provided along the side panels 28, 30 and top panel 26 of the inner housing 24. In another aspect, the insulating material 34 may only be provided along the side panels 28, 30 or only the top panel 26.

As shown in FIGS. 1, 2, 4, and 5, an exhaust port 36 may be provided on the top panel 16 of the outer housing 4. The exhaust port 36 may be generally rectangular in shape, but alternative shapes are also contemplated. As shown in FIG. 5, the exhaust port 36 may extend through the top panel 16 of the outer housing 4, through the outer cavity 22 defined between the outer housing 4 and the inner housing 24, and into the inner cavity 32 of the inner housing 24. The exhaust port 36 may define an aperture 38 therethrough. The aperture 38 may be configured to allow potentially dangerous gases and heat to escape from the inner housing 24 in a safe and efficient manner. It is also contemplated that additional exhaust ports may be provided on different portions of the outer housing 4 to further assist in evacuating the gases and heat out of the inner cavity 32.

Figure 2:
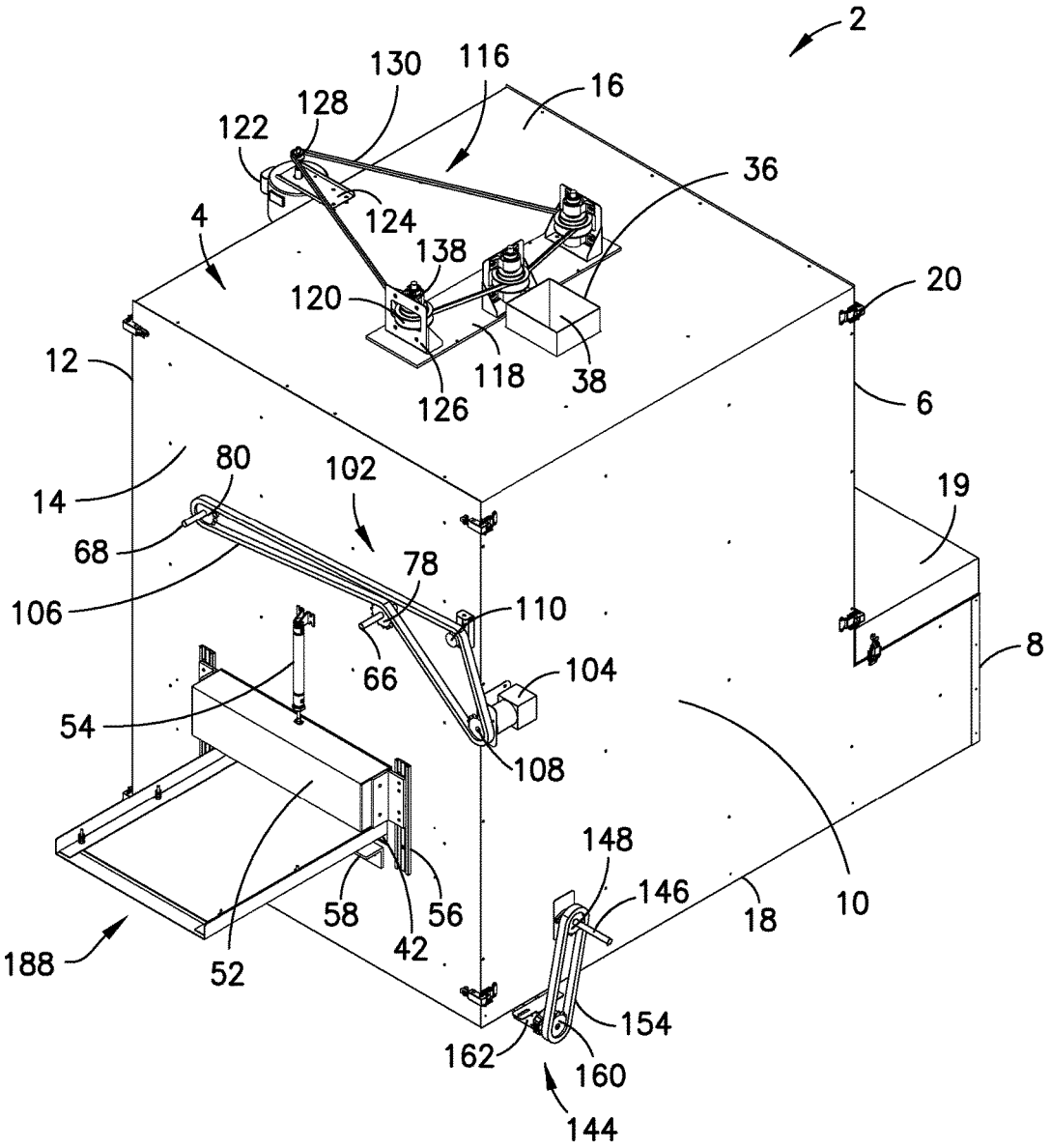
FIG. 2 is a rear perspective view of the heating system of FIG. 1.
Figure 3:
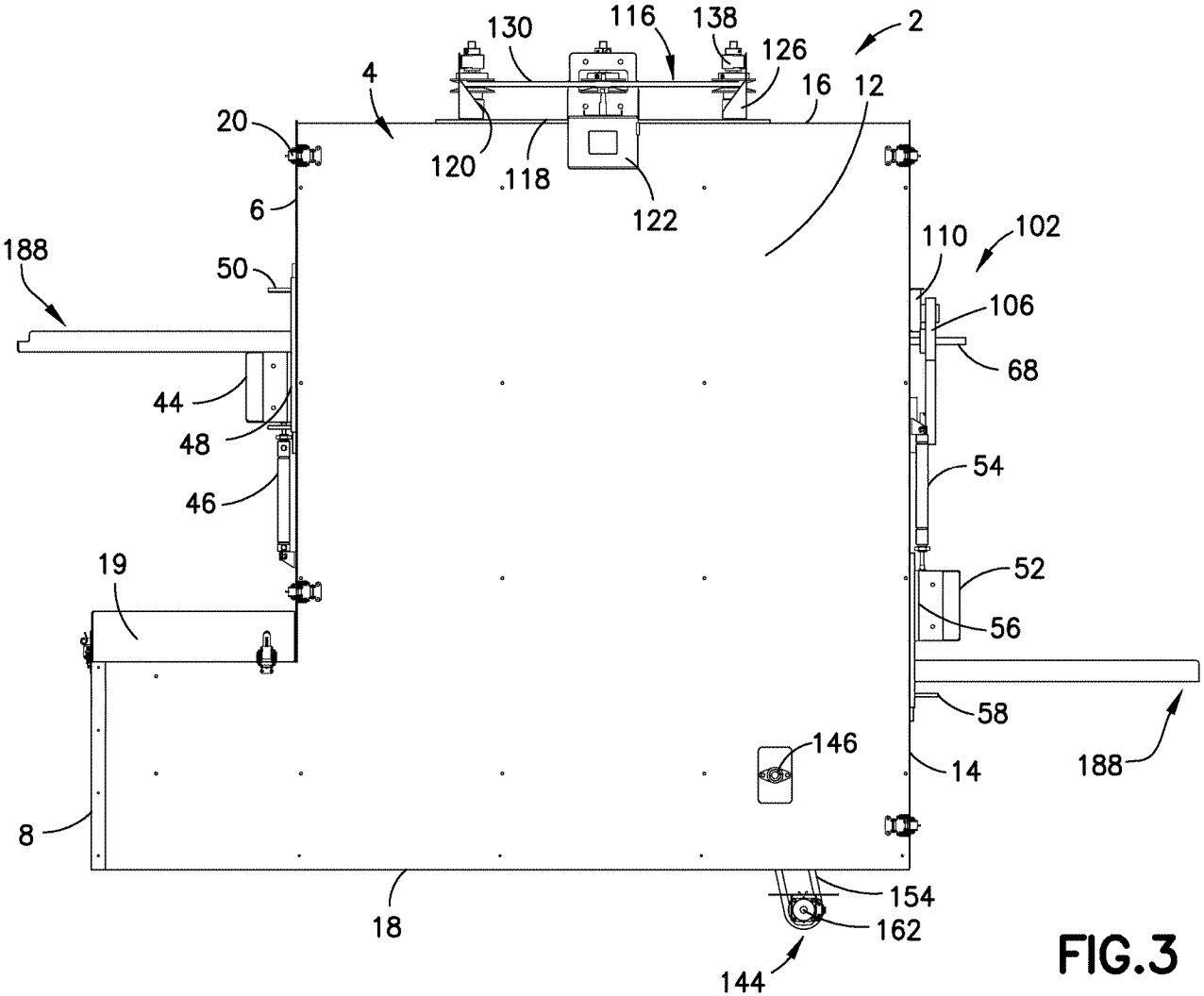
FIG. 3 is a side view of the heating system of FIG. 1.

As shown in FIGS. 1 and 2, a front opening 40 may be defined in the upper front panel 6 of the outer housing 4. Similarly, a rear opening 42 may be defined in the rear panel 14 of the outer housing 4. The openings 40, 42 may be rectangular in shape. The front opening 40 may provide access to the inner cavity 32 of the inner housing 24. The rear opening 42 may allow objects to exit the inner cavity 32. In one aspect, the front opening 40 is provided at an upper portion of the outer housing 4 and the rear opening 42 is provided at a lower portion of the outer housing 4. In this aspect, the front opening 40 may be defined in a higher portion of the outer housing 4 than the rear opening 42.

A front door 44 may slidably cover the front opening 40 to permit or prevent objects from entering the front opening 40. The front door 44 may be sized and configured to extend across the entire longitudinal length of the front opening 40 to prevent any gases or heat from escaping from the inner housing 24. A bottom surface of the front door 44 may be operatively connected to a front actuating member 46 that may be configured to move the front door 44 between an open position and a closed position. The front actuating member 46 may be attached to the upper front panel 6 of the outer housing 4. The front actuating member 46 may be positioned beneath the front opening 40. In one aspect, the front actuating member 46 may be a pneumatic cylinder. The pneumatic cylinder may be configured to bias the front door 44 towards the closed position. As the front door 44 is pressed downwardly, the pneumatic cylinder is compressed, thereby allowing access to the inner cavity 32. Once pressure is released from the front door 44, the pneumatic cylinder pushes the front door 44 back into the closed position. The front door 44 may also be operatively connected to front bearing members 48 configured to move the front door 44 between the open position and the closed position. Each side of the front door 44 may be operatively connected to a front bearing member 48 provided on each side of the front opening 40. In one aspect, the front bearing members 48 may be linear bearings. At least one front stop member 50 may be provided on an upper edge of the front opening 40. The front stop member 50 may be configured to stop movement of the front door 44 during actuation of the front actuating member 46. As the front actuating member 46 pushes the front door 44 upwardly across the front opening 40, the front stop member 50 may prevent any further upward movement of the front door 44 upon the front door 44 abutting the front stop member 50. The front stop member 50 may be attached to the upper front panel 6 of the outer housing 4. In one aspect, two front stop members 50 are provided on the outer housing 4. In one aspect, the front stop member 50 is substantially L-shaped with a bottom portion thereof stopping movement of the front door 44.

In a similar manner, a rear door 52 may slidably, cover the rear opening 42 to permit or prevent objects from exiting the rear opening 42. The rear door 52 may be sized and configured to extend across the entire longitudinal length of the rear opening 42 to prevent any gases or heat from escaping from the inner housing 24. A top surface of the rear door 52 may be operatively connected to a rear actuating member 54 that may be configured to move the rear door 52 between an open position and a closed position. The rear actuating member 54 may be attached to the rear panel 14 of the outer housing 4. The rear actuating member 54 may be positioned above the rear opening 42. In one aspect, the rear actuating member 54 may be a pneumatic cylinder. The pneumatic cylinder may be configured to bias the rear door 52 towards the closed position. As the rear door 52 is pushed upwardly, the pneumatic cylinder is compressed. Once pressure is released from the rear door 52, the pneumatic cylinder pushes the rear door 52 back into the closed position. The rear door 52 may also be operatively connected to rear bearing members 56 configured to move the rear door 52 between the open position and the closed position. Each side of the rear door 52 may be operatively connected to a rear bearing member 56 provided on each side of the rear opening 42. In one aspect, the rear bearing members 56 may be linear bearings. At least one rear stop member 58 may be provided on a lower edge of the rear opening 42. The rear stop member 58 may be configured to stop movement of the rear door 52 during actuation of the rear actuating member 54. As the rear actuating member 54 pushes the rear door 52 downwardly across the rear opening 42, the rear stop member 58 may prevent any further downward movement of the rear door 52 upon the rear door 52 abutting the rear stop member 58. The rear stop member 58 may be attached to the rear panel 14 of the outer housing 4. In one aspect, two rear stop members 58 are provided on the outer housing 4. In one aspect, the rear stop member 58 is substantially L-shaped with an upper portion thereof stopping movement of the rear door 52.

With particular reference to FIGS. 4-7, a conveyor system 60 of the heating system 2, which may also be referred to as an object transportation system, is described. The conveyor system 60 may be configured to move objects (described below) within the inner cavity 32 of the heating system 2. The conveyor system 60 may be provided within the inner cavity 32 of the inner housing 24. A pair of rear frame members 62 and a pair of front frame members 64 may be provided in the inner cavity 32 of the inner housing 24. The frame members 62, 64 may extend from and be attached to the bottom panel 18 of the outer housing 4 and the top panel 26 of the inner housing 24. The pair of rear frame members 62 may be spaced apart from one another near a rear portion of the bottom panel 18. The pair of front frame members 64 may be spaced from one another near a front portion of the bottom panel 18. The two pairs of frame members 62, 64 may be aligned with one another along the longitudinal length of the inner housing 24.

A pair of first drive shafts 66, 68 may extend from a top end of each rear frame member 62 to a corresponding top end of each front frame member 64. The first drive shafts 66, 68 may be cylindrical in shape. An upper front sprocket 70, 72, an upper intermediate sprocket 74, 76, and an upper rear sprocket 78, 80 may be rotatably connected to each first drive shaft 66, 68. Each first drive shaft 66, 68 may extend through an aperture defined in each upper front sprocket 70, 72, upper intermediate sprocket 74, 76, and upper rear sprocket 78, 80. The upper intermediate sprocket 74, 76 may be provided on the first drive shaft 66, 68 between the upper front sprocket 70, 72 and the upper rear sprocket 78, 80. Each sprocket 70-80 may include a plurality of teeth that extend from an outer circumferential surface of the sprocket 70-80 configured to engage a corresponding chain member, as will be described below. In one aspect, the upper front sprocket 70, 72 and the upper intermediate sprocket 74, 76 may be provided in the inner cavity 32 of the inner housing 24. The rear end of each first drive shaft 66, 68 may extend through the rear panel 14 of the outer housing 4 so that the upper rear sprockets 78, 80 may be provided outside of the outer housing 4.

In a similar manner to the first drive shafts 66, 68, a second drive shaft 82, 84 may extend from a bottom end of each rear frame member 62 to a corresponding bottom end of each front frame member 64. The second drive shafts 82, 84 may be cylindrical in shape. A lower front sprocket 86, 88 and a lower rear sprocket 90, 92 may be rotatably connected to each second drive shaft 82, 84. Each second drive shaft 82, 84 may extend through an aperture defined in each lower front sprocket 86, 88 and lower rear sprocket 90, 92. The lower front sprockets 86, 88 and the lower rear sprockets 90, 92 may be provided in the inner cavity 32 of the inner housing 24. Each sprocket 86-92 may include a plurality of teeth that extend from an outer circumferential surface of the sprocket 86-92 configured to engage a corresponding chain member, as will be described below.

A front chain member 94 may be operatively connected to the upper front sprocket 70 and the lower front sprocket 88. Similarly, a front chain member 96 may be operatively connected to the upper front sprocket 72 and the lower front sprocket 86. In one aspect, the front chain members 94, 96 may be made from a high temperature material, such as Teflon®, steel, or aluminum. The front chain members 94, 96 may extend from a top portion of the inner cavity 32 to a lower portion of the inner cavity 32. The circumferential teeth of the sprockets 70, 72, 86, 88 may engage with the front chain members 94, 96 so that as the sprockets 70, 72, 86, 88 are rotated, the chain is moved around the sprockets 70, 72, 86, 88. A rear chain member 98 may be operatively connected to the upper intermediate sprocket 76 and the lower rear sprocket 90. Similarly, a rear chain member 100 may be operatively connected to the upper intermediate sprocket 74 and the lower rear sprocket 92. In one aspect, the rear chain members 98, 100 may be made from a high temperature material, such as Teflon®, steel, or aluminum. The rear chain members 98, 100 may extend from an upper portion of the inner cavity 32 to a lower portion of the inner cavity 32. The circumferential teeth of the sprockets 74, 76, 90, 92 may engage with the rear chain members 98, 100 so that as the sprockets 74, 76, 90, 92 are rotated, the chain is moved around the sprockets 74, 76, 90, 92.

A conveyor drive system 102 may be operatively connected to the upper rear sprockets 78, 80 to drive the conveyor system 60. Using the conveyor drive system 102, the chain members 94-100 may be rotated around the sprockets 70-76 via the drive shafts 66, 68, 82, 84. The conveyor drive system 102 may include a motor 104 operatively connected to a drive chain 106 to drive the upper rear sprockets 78, 80. The motor 104 may be mounted to the side panel 10 of the outer housing 4. Alternatively, the motor 104 may be mounted to the rear panel 14. A drive sprocket 108 may be connected to the motor 104 to drive the drive chain 106. Upon actuation of the motor 104, the drive sprocket 108 may be rotated, thereby rotating the drive chain 106 around the upper rear sprockets 78, 80. Upon rotation of the upper rear sprockets 78, 80, the first drive shafts 66, 68 are rotated, thereby rotating the chain members 94-100. In one aspect, the motor 104 may be a stepper motor, which permits the conveyor drive system 102 to rotate in discrete steps to transfer power to each side of the conveyor system 60. It is also contemplated that a controller (not shown) may operate the motor 104 according to a desired speed. In one aspect, the drive sprocket 108 and the upper rear sprocket 80 may be provided within a loop formed by the drive chain 106. The upper rear sprocket 78 may be provided outside of the loop of the drive chain 106. A tensioning member 110 may be attached to the rear panel 14 of the outer housing 4. The tensioning member 110 may extend within the drive chain 106 to keep the drive chain 106 taut and tight on the conveyor drive system 102.

Figure 7:
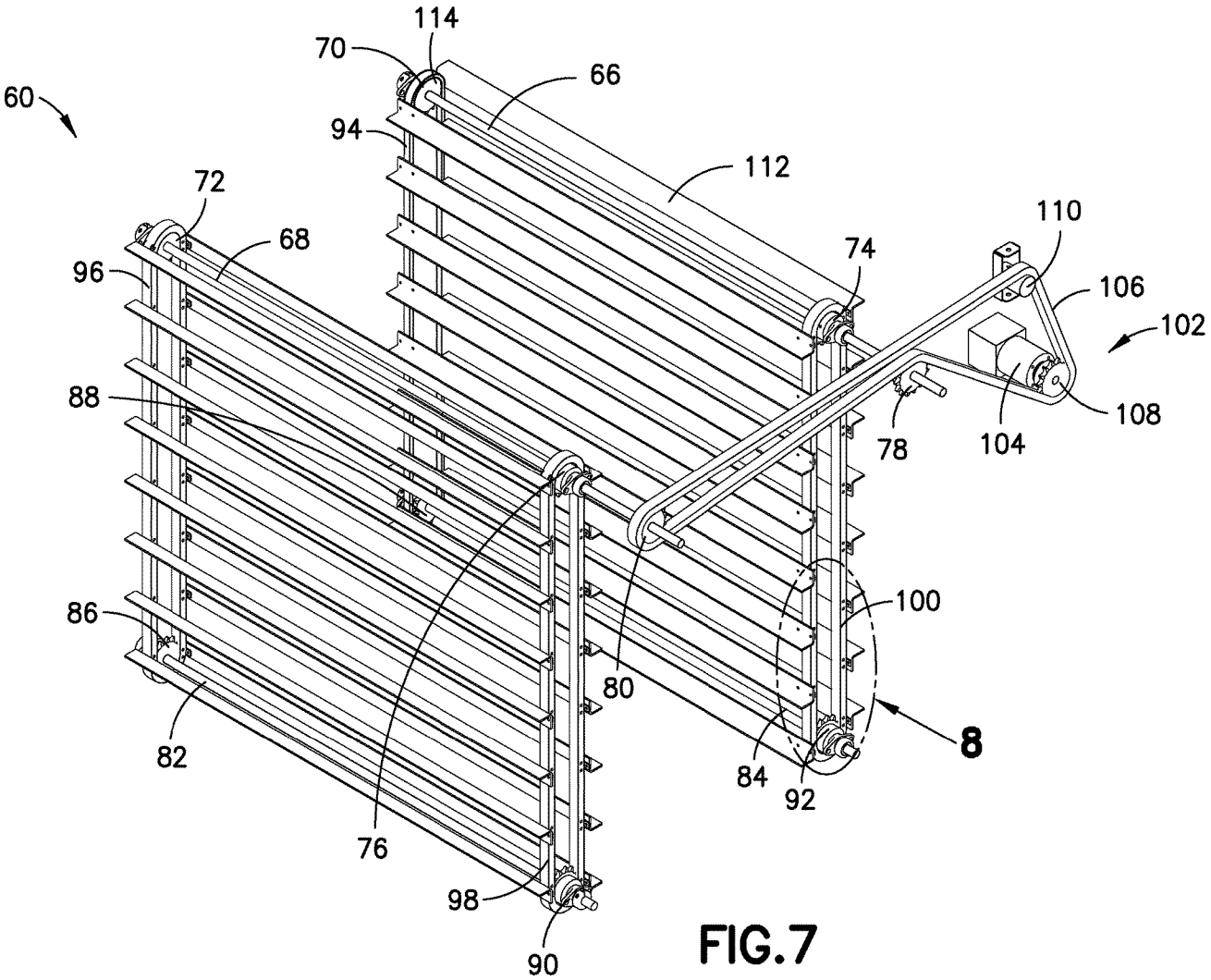
FIG. 7. is a rear perspective view of a conveyor system provided in the heating system of FIG. 1.
Figure 8:
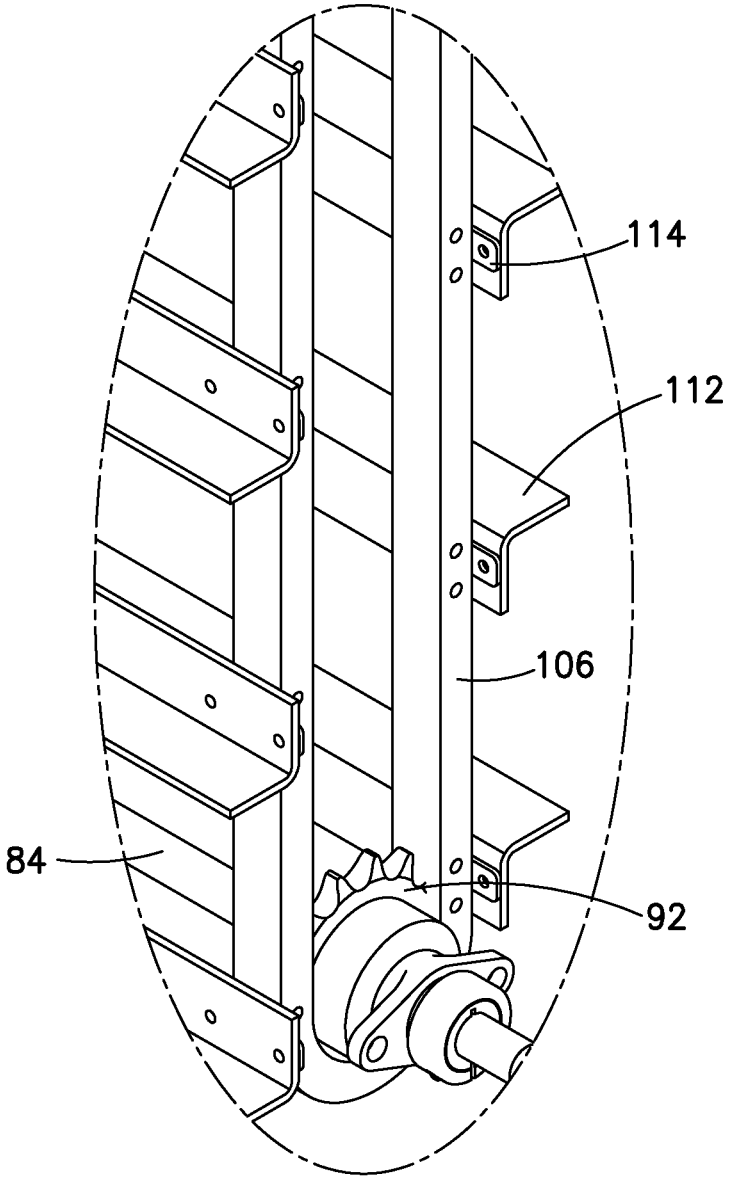
FIG. 8 is an isolated view of the connecting links of the conveyor system of FIG. 7.

As shown in FIG. 7, a plurality of platforms 112 may be attached to the drive chains 94-100 of the conveyor system 60. In one aspect, the platforms 112 may be substantially L-shaped including a first portion connected to the drive chain members 94-100 and a second portion having a seat configured to receive an object, as will be described below. In one aspect, the platforms 112 may be made of steel (such as stainless steel) or aluminum. A first end of each platform 112 may be connected to the front chain member 94, 96 and a second, opposing end of each platform 112 may be connected to the rear chain member 98, 100. As the drive chain members 94-100 are rotated, the platforms 112 are moved in a vertical direction within the inner cavity 32 of the inner housing 24. When the platforms 112 are moving on an outer portion of the conveyor system 60, the seat of the platforms 112 face downwards. As the seat of the platforms 112 are moved towards the inner portion of the conveyer system 60, the platforms 112 are rotated into an upward position to receive the objects inserted into the inner cavity 32. As shown in FIG. 8, the platforms 112 may be connected to the drive chain members 94-100 via connecting links 114 that extend through the platforms 112 and into the drive chain members 94-100. The connecting links 114 may be provided as a link in the drive chains 94-100 so the platforms 112 move with the drive chains 94-100. It is contemplated, however, that any suitable connection may be used to connect the platforms 112 to the drive chains 94-100.

With reference to FIGS. 1-5 and 9, a heating arrangement 116 for heating the inner cavity 32 of the heating system 2 is described. The heating arrangement 116 may include a platform 118 configured to hold a plurality of pulleys 120 on the top panel 16 of the outer housing 4 and a motor 122 configured to actuate the heating arrangement 116. The motor 122 may be attached to the top panel 16 of the outer housing 4 via a bracket 124. In one aspect, the motor 122 may be a single DC motor. It is also contemplated that the motor 122 may be operated using a controller (not shown) used to adjust the power output of the motor 122. It is also contemplated that a single controller may operate both the motor 104 of the conveyor drive system 102 and the motor 122 of the heating arrangement 116. Each pulley 120 may be attached to the platform 118 via a mounting bracket 126 that extends upwardly from the platform 118. In one aspect, three pulleys 120 are provided on the platform 118. In one aspect, the pulleys 120 may be adjustable pitch pulleys that are configured to adjust the tension in the heating arrangement 116. A drive pulley 128 may be operatively connected to the motor 122, such that upon actuation of the motor 122, the drive pulley 128 is rotated. The pulleys 120 and the drive pulley 128 may be connected to one another via a drive belt 130. In one aspect, the drive belt 130 may be a V-belt configured to rotate the pulleys 120 via actuation of the motor 122. Upon actuation of the motor 122, the drive pulley 128 is rotated, thereby rotating the drive belt 130. The rotation of the drive belt 130 causes rotation of the pulleys 120 on the platform 118.

A rod member 132 may extend vertically through each pulley 120. Each rod member 132 may include a fan 134, 136 on a bottom end thereof. In one embodiment, the rod members 132 on each end of the platform 118 may include down-draft fans 134 configured to push air downwards into the inner cavity 32. The rod member 132 positioned in the middle of the platform 118 may be attached to an up-draft fan 136 configured to push air out of the inner cavity 32. The down-draft fans 134 may include fins that are angled downwards into the inner cavity 32 to circulate air within the inner cavity 32. The up-draft fan 136 may include fins that are angled upwards to direct air out of the inner cavity 32. Each fan 134, 136 may be operatively connected to each respective pulley 120 via a bearing member 138. The bearing members 138 permit the fans 134, 136 to rotate with the pulleys 120 upon actuation of the motor 122. The bearing members 138 may be connected to the mounting brackets 126 provided on the platform 118.

Figure 6:
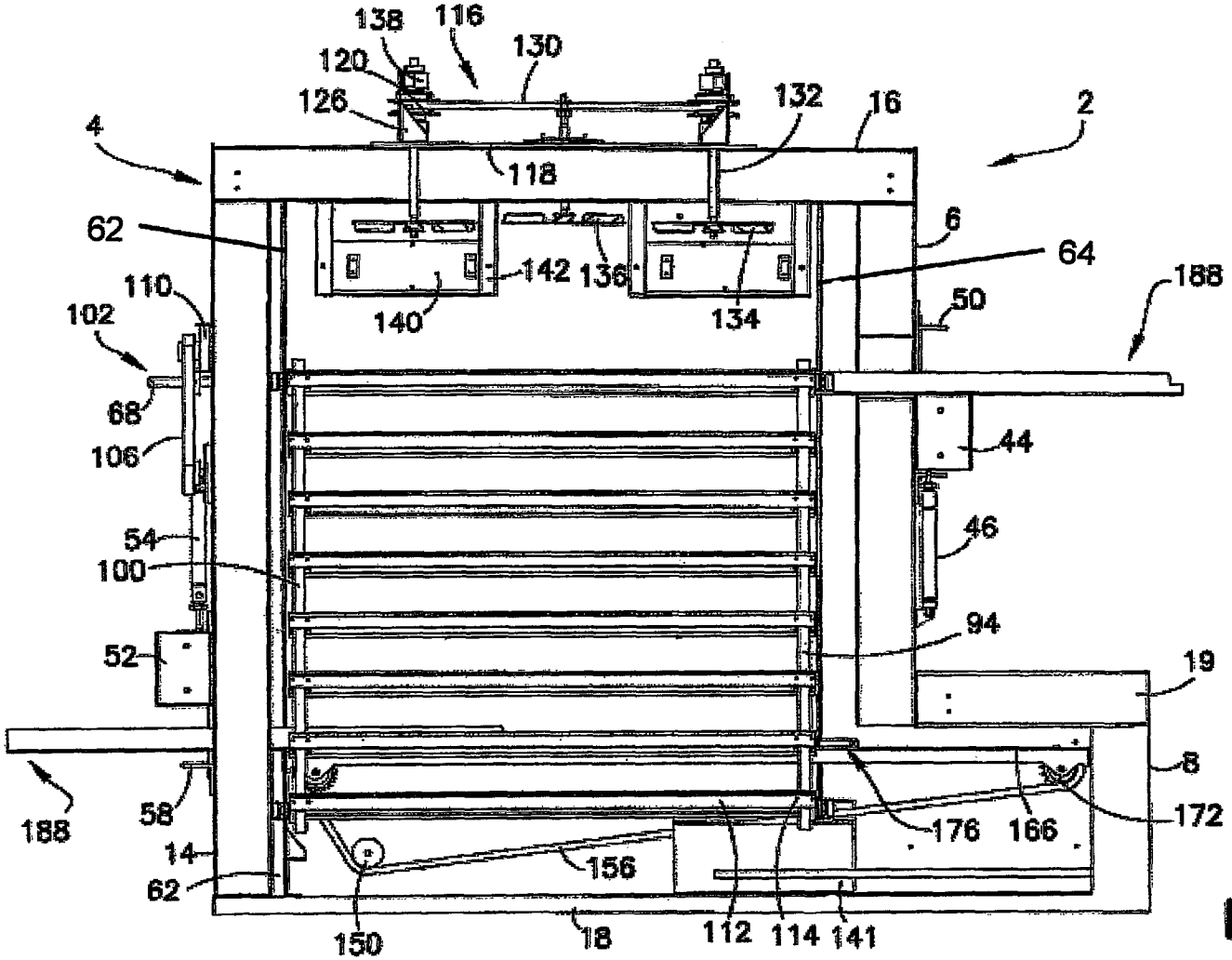
FIG. 6 is a side view of the heating system of FIG. 1 with a side panel, portions of a conveyor drive system, and portions of a pushing arrangement removed.
Figure 9:
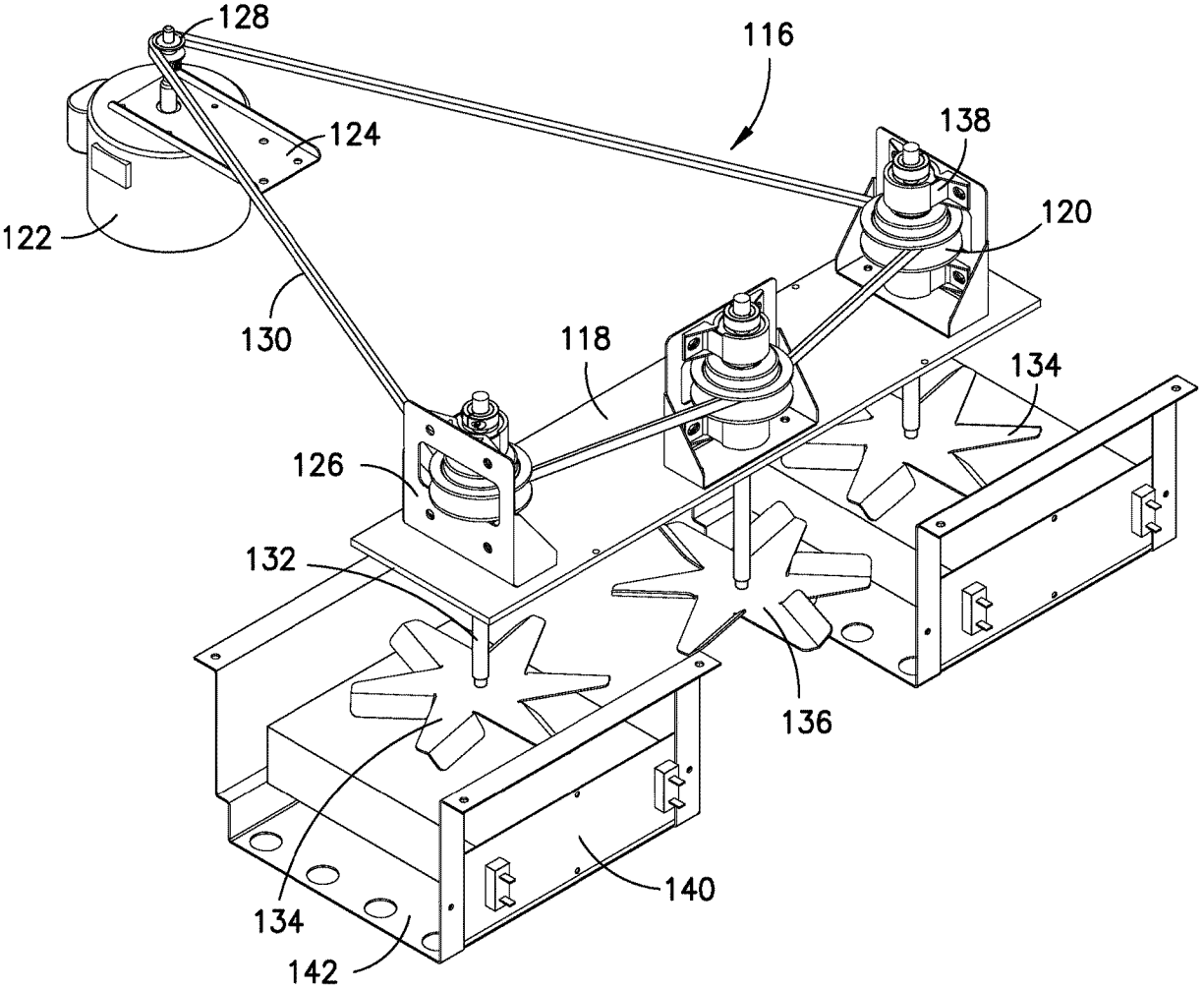
FIG. 9 is a front perspective view of a heating arrangement provided in the heating system of FIG. 1.

With reference to FIGS. 5 and 9, the heating arrangement 116 may also include a plurality of heating elements 140 provided in an upper portion of the inner cavity 32. The heating elements 140 may be configured to generate heat within the inner cavity 32. In one aspect, the heating elements 140 may provide convection heating to the inner cavity 32. With convection heating, a more uniform heat can be quickly generated in the inner cavity 32. In additional aspects, the heating elements 140 may be infrared heaters, electric resistance heaters, gas burners, or foil heaters, as well. Each heating element 140 may be attached to a mounting bracket 142 that is attached to the top panel 26 of the inner housing 24. In one aspect, the mounting brackets 142 may be substantially U-shaped with two sides that are connected to the top panel 26 and a bottom side that holds the heating elements 140. By providing the heating elements 140 in an upper portion of the inner cavity 32, the objects that are moved through the heating system 2 are not subjected to direct radiative heat. Instead, such objects may be subjected to convection heating. Convection heating allows for indirect heating of objects within the heating system 2. Convection heating also allows for a more uniform heat treatment of the objects within the heating system 2. Further, by using convection heating, the heated air is more evenly distributed throughout the heating system 2 ensuring that, regardless of the number of objects within the heating system 2, each object will receive uniform heating. The down-draft fans 134 may be configured to push the hot air generated by the heating elements 140 around the rod member 132 to provide uniform heat through the heating system 2. The up-draft fan 136 may be configured to both aid in the circulation of hot air within the inner cavity 32 and to push any excess hot air out of the exhaust port 36 to retain a safe working environment within the inner cavity 32. As shown in FIG. 6, in one aspect, an additional heating element 141 may be provided on the bottom panel 18 of the outer housing 4. The heating elements 140, 141 may be manually activated or may be activated through the use of a controller (not shown).

With reference to FIGS. 1, 2, 4, 5, 10, and 11, a pushing arrangement 144 for the heating system 2 is described. The pushing arrangement 144 is configured to push any objects that are moved through the heating system 2 out of the inner cavity 32 via the rear opening 42. The pushing arrangement 144 may be provided in a lower portion of the inner cavity 32 so that as the objects are moved downwardly in the conveyor system 60, the pushing arrangement 144 can direct the objects out of the heating system 2. The pushing arrangement 144 may include a drive shaft 146 that extends transversely through the inner cavity 32 of the inner housing 24. The drive shaft 146 may extend through the side panels 10, 12, 28, 30 on each side of the outer housing 4 and the inner housing 24. At least three sprockets 148, 150, 152 may be rotatably provided on the drive shaft 146. The sprockets 148-152 may include teeth extending from the outer circumferential surface of the sprockets 148-152 to engage chain members 154, 156, 158. The chain members 154-158 may be provided around the outer surface of the sprockets 148-152.

One sprocket 148 may be operatively connected to a drive sprocket 160 via the chain member 154. The drive sprocket 160 may be operatively connected to a mounting structure 162 attached to the bottom panel 18 of the outer housing 4. A motor 164 may be provided on the mounting structure 162 to rotate the drive sprocket 160, thereby rotating the sprocket 148 via the chain member 154. The rotation of the sprocket 148 causes rotation of the drive shaft 146, causing the remaining sprockets 150, 152 to rotate on the drive shaft 146.

Figures 10, 11:
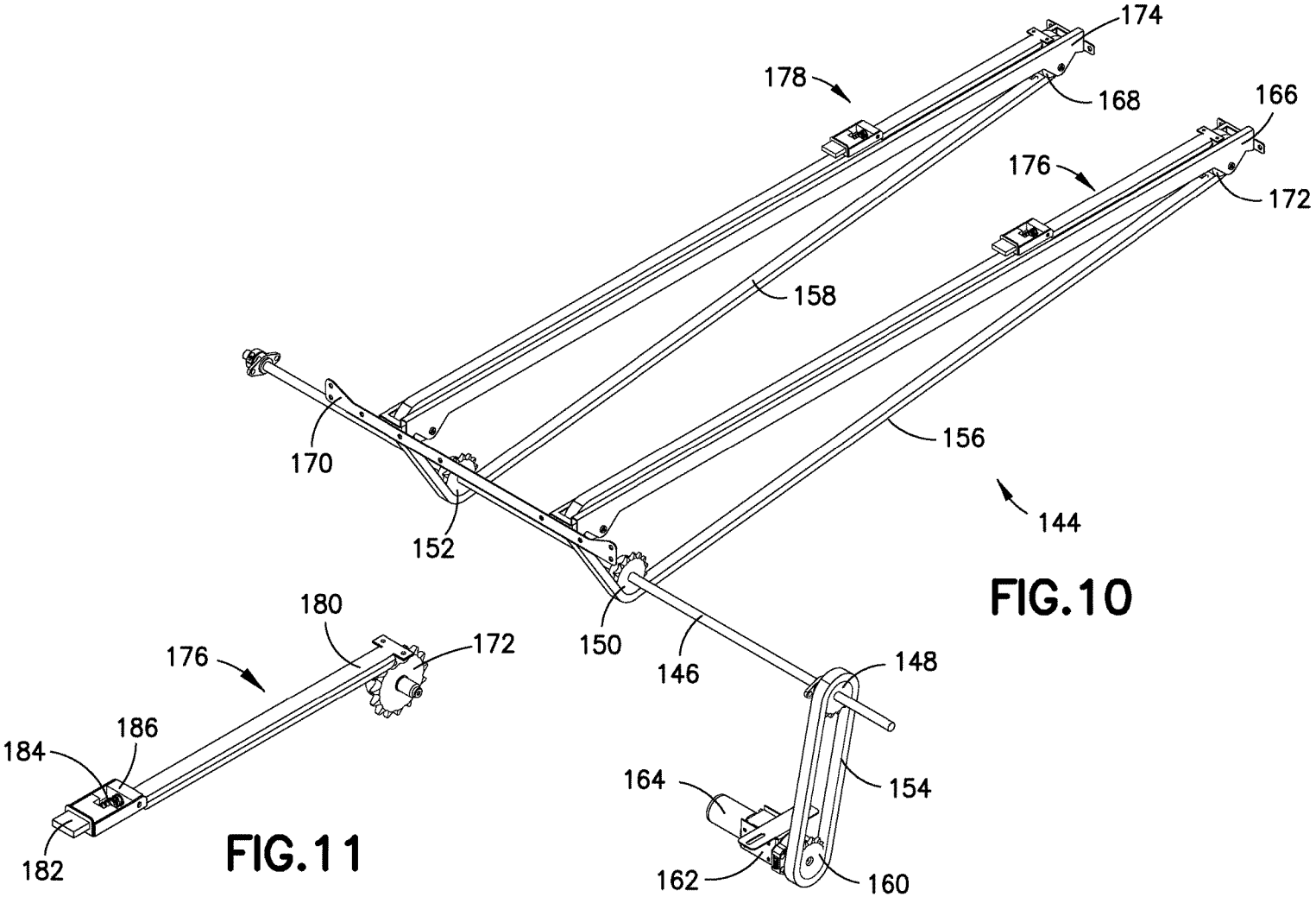
FIG. 10 is a rear perspective view of a pushing arrangement provided in the heating system of FIG. 1.
FIG. 11 is an isolated view of a pusher mechanism of the pushing arrangement of FIG. 10.

As shown in FIGS. 4, 6, and 10, the chain members 156, 158 provided on the drive shaft 146 may be provided in a pusher frame 166, 168 that is connected to a cross member 170 and the lower front panel 8 of the outer housing 4. The cross member 170 may be attached to the rear frame members 62. A front end of each pusher frame 166, 168 may be attached to an inner surface of the lower front panel 8 and a rear end of each pusher frame 166, 168 may be connected to the cross member 170. A sprocket 172, 174 may be provided in each front end of the pusher frames 166, 168 that is positioned near the lower front panel 8. Similarly, a sprocket (not shown) may be provided in each rear end of the pusher frames 166, 168. The chain members 156, 158 may be wrapped around the sprockets 172, 174 so that the sprockets 172, 174 are connected to the sprockets 150, 152, respectively, via the chain members 156, 158. As the sprockets 150, 152 are rotated by the drive shaft 146, the chain members 156, 158 are rotated, thereby rotating the sprockets 172, 174. The chain members 156, 158 may be provided in the pusher frames 166, 168.

As shown in FIGS. 10 and 11, on each chain member 156, 158 there is provided a pusher mechanism 176, 178. The pusher mechanisms 176, 178 may be attached to the links of the chain members 156, 158. The pusher mechanisms 176, 178 are configured to push objects out of the rear opening 42 of the outer housing 4. The pusher mechanism 176 is shown in detail in FIG. 11. It is to be understood, however, that the other pusher mechanism 178 may have the same configuration as this pusher mechanism 176. The pusher mechanism 176 includes a housing 180 that is operatively connected to the chain member 156. A button 182 is provided on a front end of the housing 180 and is operatively connected to a spring relief valve 184. Upon actuation of the button 182, the button 182 is pushed back into the spring relief valve 184. The spring relief valve 184 is configured to bias the button 182 towards an extended position. As pressure is released from the button 182, the spring relief valve 184 pushes the button 182 outwardly to an original resting position. A stop member 186 may be provided behind the spring relief valve 184 to limit the distance that the button 182 may push the spring relief valve 184. The pusher mechanisms 176, 178 are configured to move forward upon rotation of the chain members 156, 158 to push any objects out of the heating system 2. In use, the button 182 of each pusher mechanism 176, 178 comes into contact with a back stop 198 of a clamping arrangement 188 that holds the object (described below). The pusher mechanisms 176, 178 continue to move with the chain members 156, 158, which pushes the button 182 and the clamping arrangement 188 out of the heating system 2 via the rear opening 42. After the object has been pushed out of the heating system 2, the sprockets 172, 174 and the chain members 156, 158 may be rotated in an opposite direction to bring the pusher mechanisms 176, 178 back into an original resting position.

Figure 12:
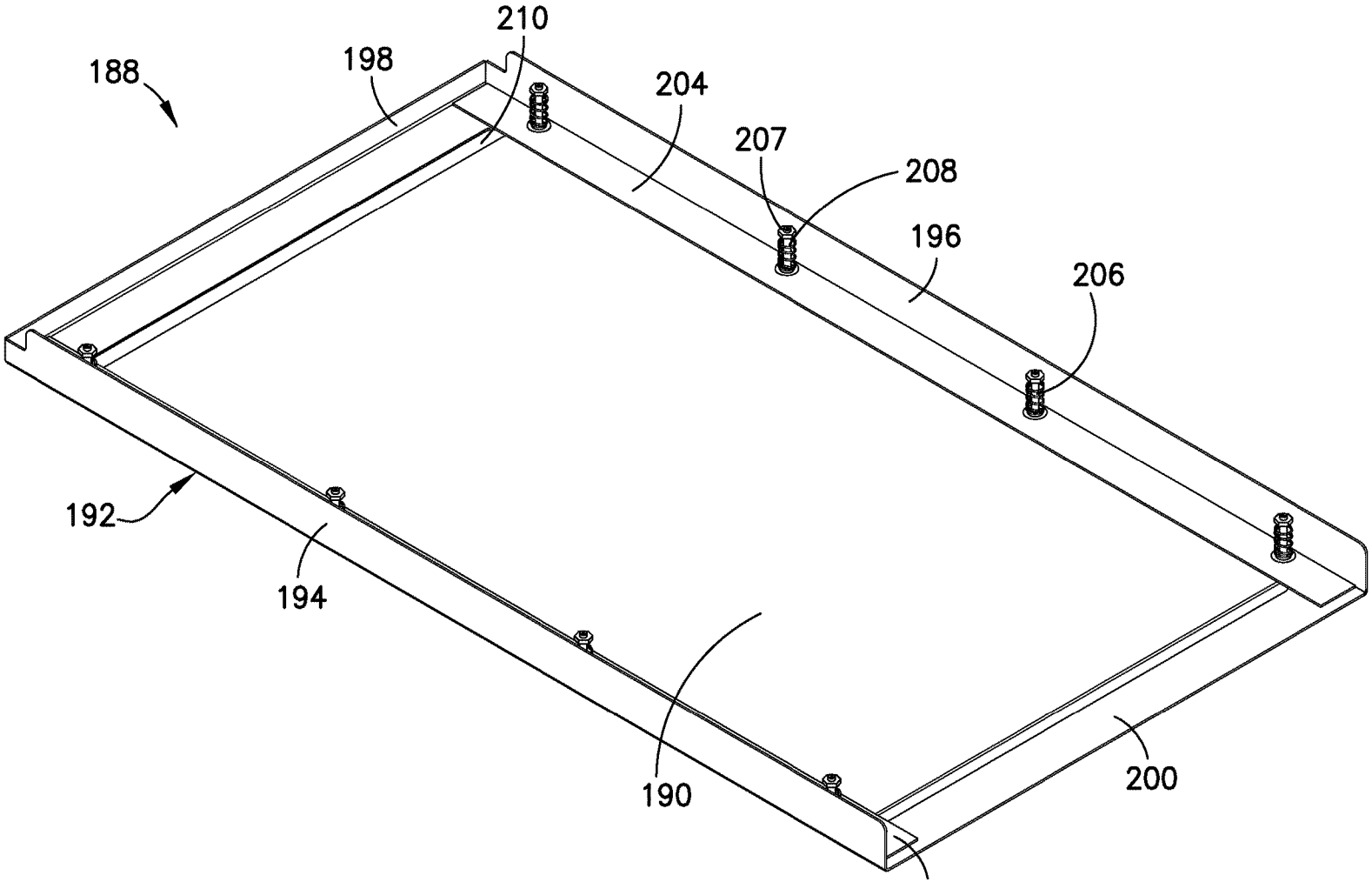
FIG. 12 is a front perspective view of a clamping arrangement to be used with the heating system of FIG. 1.
Figure 13:
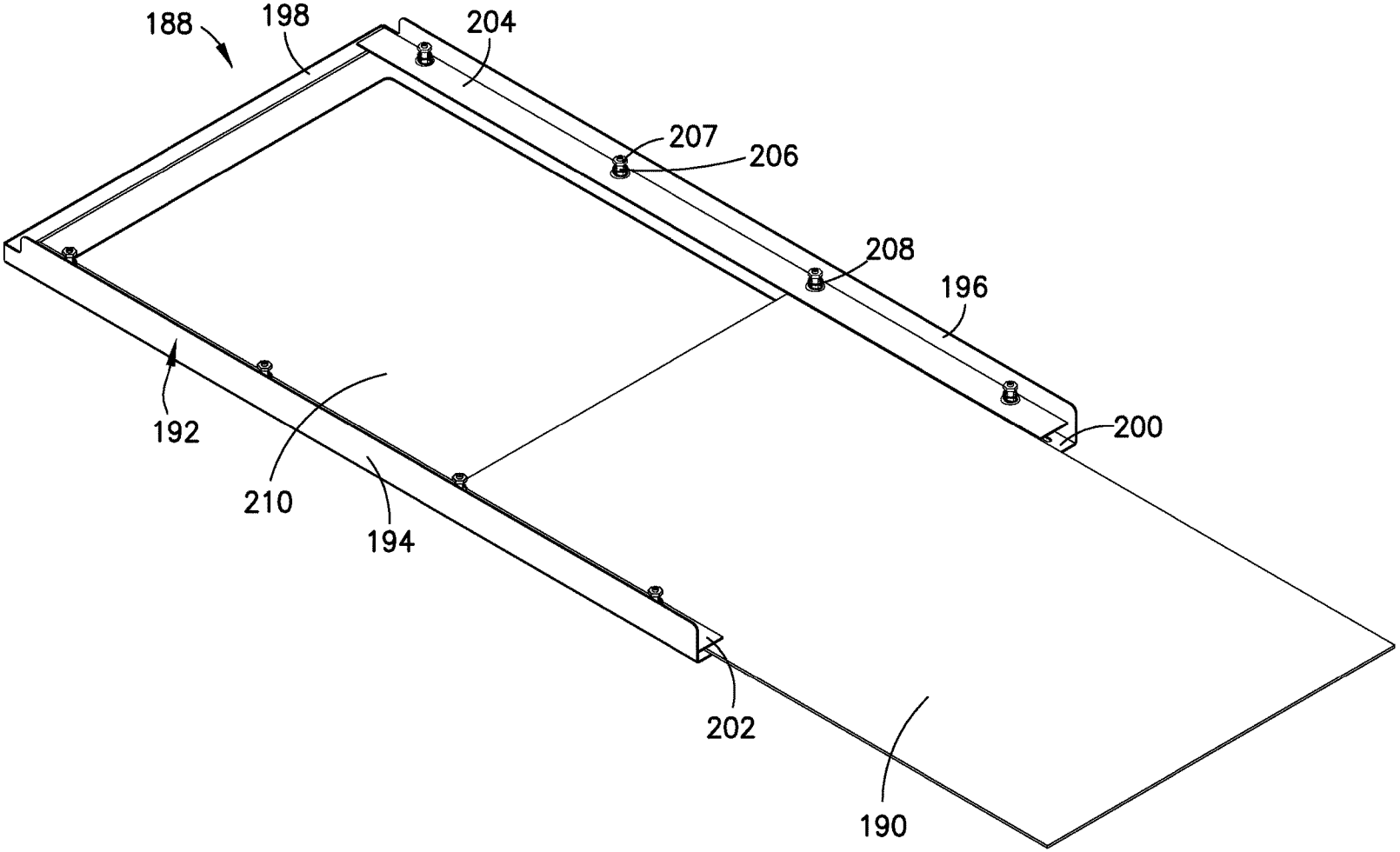
FIG. 13 is a front perspective view of the clamping arrangement of FIG. 12 with a composite material being removed therefrom.

With reference to FIGS. 12 and 13, a clamping arrangement 188 for holding the objects within the heating system 2, which may also be referred to as an object holding arrangement, is described. In one aspect, the clamping arrangement 188 is configured to hold a composite material 190 that is to be heated within the heating system 2. It is also contemplated that other materials that may need to be heated to a desired temperature may be held in the clamping arrangement 188. The clamping arrangement 188 may include a frame member 192 that may be substantially rectangular in shape. The frame member 192 may include two side members 194, 196, a back stop 198 that extends between the two sides 194, 196, and a front frame member 200 that extends between the two side members 194, 196. A clamping member 202, 204 may be provided on each side of the frame member 192. The clamping members 202, 204 are provided on the frame member 192 via a plurality of studs 206 that extend from a lower portion of the side members 194, 196. The studs 206 extend through apertures defined in each of the clamping members 202, 204. The clamping members 202, 204 are biased to a clamped, closed position by compression springs 208 that are provided on each stud 206 and retained on the studs 206 using nuts 207. The compression springs 208 are configured to press the clamping members 202, 204 downwards relative to the frame member 192 to clamp the composite material 190 between the side members 194, 196 and the respective clamping member 202, 204 within the frame member 192.

When the composite material 190 is clamped within the frame member 192, the composite material 190 rests on lower portions of the raised sides 194, 196. In this clamped position, the composite material 190 extends across the frame member 192. The composite material 190 may be sized such that a cavity 210 is defined with frame member 192 to allow the heated air to contact an under surface of the composite material 190 during the heating process. To insert the composite material 190 into the frame member 192, the clamping members 202, 204 may be lifted to allow the composite material 190 to slide into the frame member 192. Once the composite material 190 has been properly inserted in the frame member 192, the clamping members 202, 204 may be released to move back into the clamped position via the compression springs 208. After the composite material 190 has been inserted into the frame member 192, the clamping arrangement 188 may be inserted into the front opening 40 of the outer housing 4 to heat the composite material 190 in the heating system 2. This process is described in greater detail below. Although a clamping arrangement 188 has been described to hold the composite material 190 within the heating system 2, it is to be understood that alternative holding configurations may be used to hold the composite material 190, such as a friction fit arrangement or alternative clamping arrangements. It is also to be understood that a frame member 124 does not need to be used. Instead, the composite material 190 may be held together using clamping clips or similar clamping members without the use of a frame member.

With reference to FIGS. 1-5, a method of heating a composite material 190 within the heating system 2 is described. Using the described method, an operator may use a clamping arrangement 188 to hold a composite material 190 to be moved through the heating system 2. The clamping members 202, 204 may be lifted to allow insertion of the composite material 190 into the clamping arrangement 188. As the clamping members 202, 204 are lifted, the springs 208 may be compressed. Upon releasing lifting pressure on the clamping members 202, 204 after the composite material 190 has been inserted therein, the compressed springs 208 push the clamping members 202, 204 back into an original resting position that clamps the composite material 190 between the clamping members 202, 204 and the frame member 192. This process of inserting the composite material 190 into the clamping arrangement 188 may be manually performed by an operator or automated through the use of a robotic arm and/or robotic assembly (not shown).

After the composite material 190 has been inserted into the clamping arrangement 188, the clamping arrangement 188 is inserted into the heating system 2 via the front opening 40. The front door 44 may be opened to permit passage of the clamping arrangement 188 through the front opening 40. As the front door 44 is pushed downward to allow passage of the clamping arrangement 188, the front actuating member 46 may be compressed. Due to the compression of the front actuating member 46, once the clamping arrangement 188 has passed through the front opening 40, the front door 44 is biased into a closed position. The front door 44 will close behind the clamping arrangement 188 after the clamping arrangement 188 has been fully inserted into the heating system 2. During insertion of the clamping arrangement 188 through the front opening 40, the clamping arrangement 188 may be directed into the inner cavity 32 of the inner housing 24.

As the clamping arrangement 188 enters the inner cavity 32, the clamping arrangement 188 may be positioned on the seats of opposing platforms 112 that are connected to the chain members 94-100 of the conveyor system 60. The frame member 192 of the clamping arrangement 188 may be configured to rest on a lower portion of the L-shaped platforms 112. The clamping arrangement 188 may be inserted in the inner cavity 32 until the entire clamping arrangement 188 is resting on platforms 112. The platforms 112 may be configured to move the clamping arrangement 188 within the inner cavity 32. It is also contemplated that after a first set of opposing platforms 112 are moved downwardly with the clamping arrangement 188 resting thereon, another clamping arrangement 188 may be inserted into the inner cavity 32 to rest on another set of opposing platforms 112. In this manner, a plurality of clamping arrangements 188 may be moved through the inner cavity 32 via the conveyor system 60. This method allows for continuous movement of a plurality of clamping arrangement 188 through the heating system 2. For example, as one clamping arrangement 188 is exiting from the heating system 2, another clamping arrangement 188 may be inserted into the heating system 2.

The conveyor system 60 may be moved via the motor 104. Upon activation of the motor 104, the drive sprocket 108 may be rotated to drive the drive chain 106. As the drive chain 106 is rotated, the upper rear sprockets 78, 80 are rotated. Rotation of the upper rear sprockets 78, 80 causes rotation of the first drive shafts 66, 68. By rotating the first drive shafts 66, 68, the upper front sprockets 70, 72 and the upper intermediate sprockets 74, 76 are also rotated. The rotation of the upper front sprockets 70, 72 and the upper intermediate sprockets 74, 76 causes rotation of the chain members 94-100, which are connected to the upper front sprockets 70, 72 and the upper intermediate sprockets 74, 76. The rotation of the chain members 94-100 also causes rotation of the lower front sprockets 86, 88 and the lower rear sprockets 90, 92. By providing the upper rear sprocket 80 within the drive chain 106 of the conveyor drive system 102 and providing the upper rear sprocket 78 outside of the drive chain 106, the first set of chain members 96, 98 rotate in an opposite direction to the second set of chain members 94, 100. As shown in FIG. 5, the first set of chain members 96, 98 may be rotated in direction A and the second set of chain members 94, 100 may be rotated in direction B. In one aspect, direction A may be a counterclockwise direction and direction B may be a clockwise direction. In one aspect, the conveyor drive system 102 may be configured to rotate the first set of chain members 96, 98 and the second set of chain members 94, 100 inwardly towards one another.

The motor 104 may be configured to drive the chain members 94-100 at varying speeds depending on the desired amount of time that the composite material 190 should be heated within the heating system 2. The motor 104 may drive the chain members 94-100 at a faster speed to move the clamping arrangement 188 relatively quickly through the inner cavity 32. Alternatively, the motor 104 may drive the chain members 94-100 at a lower speed to move the clamping arrangement 188 relatively slowly through the inner cavity 32. Using this method, the heat treatment of the composite material 190 in the heating system 2 may be adjusted. For example, the residence time in the heating system 2 for the composite material 190 may be adjusted based on the speed of rotation of the chain members 94-100 and/or the temperature of the heated air generated by the heating elements 140, 141. As the platforms 112 are rotated on the chain members 94-100, the seats of the platforms 112 may face downwardly when the platforms 112 are positioned at an outside portion of the chain members 94-100. Upon rotating inwardly, the platforms 112 are rotated with the chain members 94-100 into an upright position. As the platforms 112 are rotated into the upright position at the top of the conveyor system 60, the clamping arrangement 188 may be inserted into the inner cavity 32 and onto the platforms 112. The platforms 112 will move the clamping arrangement 188 downwardly in the inner cavity 32, thereby heating the composite material 190 as the clamping arrangement 188 moves through the inner cavity 32.

The heating arrangement 116 of the heating system 2 may be configured to provide heated air in the inner cavity 32 to raise the temperature of the composite material 190. Upon activation of the heating elements 140, hot air may be generated within the inner cavity 32. The heating elements 140 may be activated with a switch (not shown) or remotely controlled by an operator or controller. The heating elements 140 provided in the upper portion of the inner cavity 32 may direct heated air downwards towards the conveyor system 60. The heating element 141 provided in the bottom portion of the inner cavity 32 may direct heated air upwards towards the conveyor system 60. The down-draft fans 134 may be rotated to push the heated air from the heating elements 140 even further downwards towards the conveyor system 60. The down-draft fans 134 may also be configured to circulate the heated air throughout the inner cavity 32. The up-draft fan 136 may be rotated to assist in circulating the heated air within the inner cavity 32, as well as directing any excess heated air and gases out of the inner cavity 32 via the exhaust port 36. Upon activation of the motor 122, the drive pulley 128 may be rotated, thereby starting the rotation of the drive belt 130. The rotation of the drive belt 130 may rotate the pulleys 120 connected to the down-draft fans 134 and the up-draft fans 136.

Upon reaching the lower portion of the conveyor system 60 in the inner cavity 32, the clamping arrangement 188 will come in contact with the pusher mechanisms 176, 178. As the platforms 112 are lowered in the inner cavity 32, the bottom surface of the frame member 192 of the clamping arrangement 188 is brought into contact with the upper surface of the pusher mechanisms 176, 178 so that the clamping arrangement 188 is brought to rest on the pusher mechanisms 176, 178. The platforms 112 are spaced at a distance from the pusher mechanisms 176, 178 to allow the platforms 112 to continue rotating with the chain members 94-100, while the clamping arrangement 188 is left on the pusher mechanisms 176, 178.

The pusher mechanisms 176, 178 may then be activated to push the clamping arrangement 188 out of the inner cavity 32 via the rear opening 42. It is contemplated that the pusher mechanisms 176, 178 may be activated with a motion sensor (not shown) or pressure sensor (not shown) provided on the pusher mechanisms 176, 178 that activates the motor 164 to rotate the pusher mechanisms 176, 178. Upon activation of the motor 164, the drive sprocket 160 is rotated, thereby rotating the chain member 154. The chain member 154 may cause rotation of the sprocket 148, which will cause rotation of the drive shaft 146 connected thereto. Rotation of the drive shaft 146 causes rotation of the sprockets 150, 152. The rotation of the sprockets 150, 152 causes rotation of the chain members 156, 158, which move the pusher mechanisms 176, 178 towards the rear end of the heating system 2. The pusher mechanisms 176, 178 are moved until contacting the clamping arrangement 188. The pusher mechanisms 176, 178 may contact and press against the back stop 198 of the clamping arrangement 188. The buttons 182 of the pusher mechanisms 176, 178 may contact the clamping arrangement 188, thereby compressing the spring relief valve 184 until contacting the stop member 186. The spring relief valve 184 provides a smoother transition of contact between the button 182 and the clamping arrangement 188. The spring relief valve 184 also assists in reducing wear on the motor 164 when the clamping arrangement 188 reaches its final resting position. The clamping arrangement 188 contacts the stop member 186 via the spring relief valve 184, thereby reducing the stress on the motor 164, allowing the motor 164 to continue running instead of stalling. The chain members 156, 158 will continue to be rotated, thereby continuing to push the clamping arrangement 188 out of the inner cavity 32 via the pusher mechanisms 176, 178. The clamping arrangement 188 may be pushed completely out of the inner cavity 32 via the rear opening 42 after the rear door 52 has been opened.

After the clamping arrangement 188 is pushed out of the inner cavity 32, the rear door 52 may be closed behind the clamping arrangement 188 to keep the heated air within the inner cavity 32. Further, after the clamping arrangement 188 is pushed out of the inner cavity 32, the motor 164 may reverse the direction of rotation to move the pusher mechanisms 176, 178 in an opposite direction to bring the pusher mechanisms 176, 178 to an original resting position. The clamping arrangement 188 may be retrieved from the heating system 2 by an operator or robotic arm or robotic system (not shown). It is also contemplated that the clamping arrangement 188 may be moved into a forming area along a conveyor belt or a similar transportation system (not shown).

While an aspect of a heating system for heating, composite materials is shown in the accompanying figures and described in detail hereinabove, other aspects will be apparent to, and readily made by, those skilled in the art without departing from the scope and spirit of the invention. Accordingly, the foregoing description is intended to be illustrative rather than restrictive. The disclosure described hereinabove is defined by the appended claims and all changes to the disclosure that fall within the meaning and the range of equivalency of the claims are to be embraced within their scope.

The invention claimed is:

1. A heating system for heating composite materials, comprising:
- a housing defining a cavity therein;
- a vertical conveyor system provided in the cavity of the housing for moving objects through the housing;
- a heating arrangement provided in the housing for heating the objects as the objects are moved at least vertically through the housing; and
- at least one pusher mechanism provided in a lower portion of the cavity of the housing,
- wherein the at least one pusher mechanism is configured to push the objects out of the housing,
- wherein the vertical conveyor system comprises:
  - at least two vertical chain member arrangements, and
  - at least one platform attached to each vertical chain member arrangement, and
- wherein, when the objects are seated on the platforms and the vertical chain member arrangements rotate within the housing, the objects and platforms are lowered from an upper portion of the cavity of the housing to a lower portion of the cavity of the housing.

2. The heating system as claimed in claim 1, wherein the heating arrangement comprises at least one heating element provided in at least one of an upper portion of the housing and a lower portion of the housing.

3. The heating system as claimed in claim 1, wherein the heating arrangement comprises at least one fan to circulate heated air generated by the heating arrangement throughout the cavity of the housing.

4. The heating system as claimed in claim 3, wherein the heating arrangement further comprises at least one down-draft fan configured to move the heated air into the cavity of the housing and an up-draft fan configured to push the heated air out of the cavity of the housing.

5. The heating system as claimed in claim 1, wherein the at least one pusher mechanism comprises:
- a rotatable chain member; and
- a pusher housing provided on the chain member,
- wherein, as the chain member is rotated, the pusher housing contacts the objects and pushes the objects out of the cavity of the housing.

6. The heating system as claimed in claim 1, wherein the housing comprises:
- an outer housing; and
- an inner housing provided within the outer housing,
- wherein the vertical conveyor system and the heating arrangement are provided in the inner housing.

7. The heating system as claimed in claim 6, wherein the housing further comprises an insulation layer provided between the outer housing and the inner housing.

8. The heating system as claimed in claim 1, further comprising an exhaust port defined in a top surface of the housing.

9. The heating system as claimed in claim 1, further comprising:

a front opening defined in a front surface of the housing and a front door provided over the front opening; and a rear opening defined in a rear surface of the housing and a rear door provided over the rear opening, wherein the front opening receives the objects to be heated in the heating system and the rear opening discharges the objects once the objects have been heated, and wherein the front opening is defined in a higher portion of the housing than the rear opening.

10. The heating system as claimed in claim 9, wherein the front door and/or the rear door are biased towards a closed position via an actuating member.

11. A heating system for heating composite materials, comprising:

a housing defining a cavity therein;

an object transportation system provided in the cavity of the housing for moving objects through the housing;

a heating arrangement provided in the housing for heating the objects that are moved through the housing; and at least one object holding arrangement configured to hold the object as the object is moved through the heating system, the at least one object holding arrangement comprising a frame member and at least one clamping member biased against a top surface of the frame member, wherein the frame member and the at least one clamping member are arranged to hold the object therebetween, wherein the object transportation system comprises:

at least two vertical chain member arrangements, and at least one platform attached to each vertical chain member arrangement, and wherein, when the objects are seated on the platforms and the vertical chain member arrangements rotate within the housing, the objects and platforms are lowered from an upper portion of the cavity of the housing to a lower portion of the cavity of the housing.

12. The heating system as claimed in claim 11, wherein at least one compression spring is provided on the at least one clamping member to bias the at least one clamping member against the frame member.

13. The heating system as claimed in claim 11, wherein the frame member defines a cavity therein.

14. The heating system as claimed in claim 11, wherein the at least one object holding arrangement is removably positioned on the conveyor system to move the object holding arrangement within the heating system.

15. A method of heating a composite material in a heating system, comprising:

a) inserting a composite material into a heating system;

b) generating heated air within the heating system;

c) moving the composite material in a vertical direction through an interior cavity of the heating system using an object transportation system, thereby heating the composite material with the heated air; and d) discharging the composite material from the heating system by pushing the composite material out of the heating system using a pusher mechanism provided in the heating system, wherein the object transportation system comprises:

at least two vertical chain member arrangements, and at least one platform attached to each vertical chain member arrangement, and wherein, when the objects are seated on the platforms and the vertical chain member arrangements rotate within the heating system, the objects and platforms are lowered from an upper portion of the interior cavity of the heating system to a lower portion of the interior cavity of the heating system.

16. The method of heating a composite material as claimed in claim 15, further comprising clamping the composite material in an object holding arrangement before inserting the composite material into the heating system.

* * * * *